US007753712B2

(12) United States Patent
Miki

(10) Patent No.: US 7,753,712 B2
(45) Date of Patent: Jul. 13, 2010

(54) CONNECTOR PLUG

(75) Inventor: Kenji Miki, Yao (JP)

(73) Assignee: Hosiden Corporation, Yao-shi, Osaka (JP)

( * ) Notice: Subject to any disclaimer, the term of this patent is extended or adjusted under 35 U.S.C. 154(b) by 0 days.

(21) Appl. No.: 12/155,862

(22) Filed: Jun. 11, 2008

(65) Prior Publication Data

US 2008/0311783 A1 Dec. 18, 2008

(30) Foreign Application Priority Data

Jun. 13, 2007 (JP) ..... 2007-156727

(51) Int. Cl.
*H01R 13/627* (2006.01)

(52) U.S. Cl. ..... 439/353; 439/352

(58) Field of Classification Search ..... 439/370, 439/352, 353, 357, 358
See application file for complete search history.

(56) References Cited

U.S. PATENT DOCUMENTS 5,397,246 A * 3/1995 Defibaugh et al. ..... 439/352
7,134,900 B2 * 11/2006 Chung ..... 439/353

FOREIGN PATENT DOCUMENTS

| | | |
|---|---|---|
| JP | 2001 291556 | 10/2001 |
| JP | 2002 198125 | 7/2002 |
| JP | 2003 243093 | 8/2003 |
| JP | 2004 087462 | 3/2004 |

* cited by examiner

*Primary Examiner*—Tho D Ta
*Assistant Examiner*—Travis Chambers
(74) *Attorney, Agent, or Firm*—Bacon & Thomas, PLLC

(57) ABSTRACT

The invention provides a connector plug in which a necessary and sufficient engaging force of a latch can be ensured irrespective of the thickness of a metal case. The connector plug of the invention has: a synthetic-resin made body (10) having a fitting portion (11) to which a counter connector socket is to be fitted, and which is projected from one end side; contacts (20) which are held by the body (10); and a metal case (40) which covers the body (10). A latch (30) which, when the fitting portion (11) of the body (10) is inserted into the counter connector socket, causes the fitting portion to be engaged with the counter connector socket, and which is formed by a metal plate is configured separately from the metal case (40). The latch (30) is held by the body (10).

20 Claims, 4 Drawing Sheets

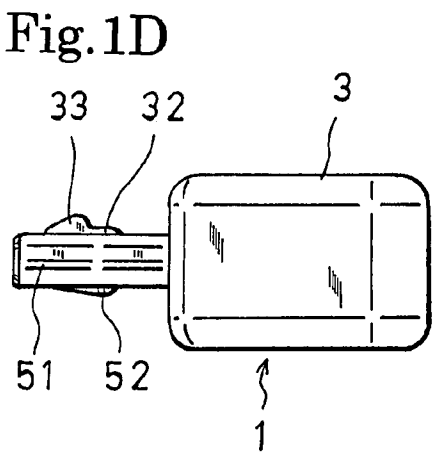
Fig.1D
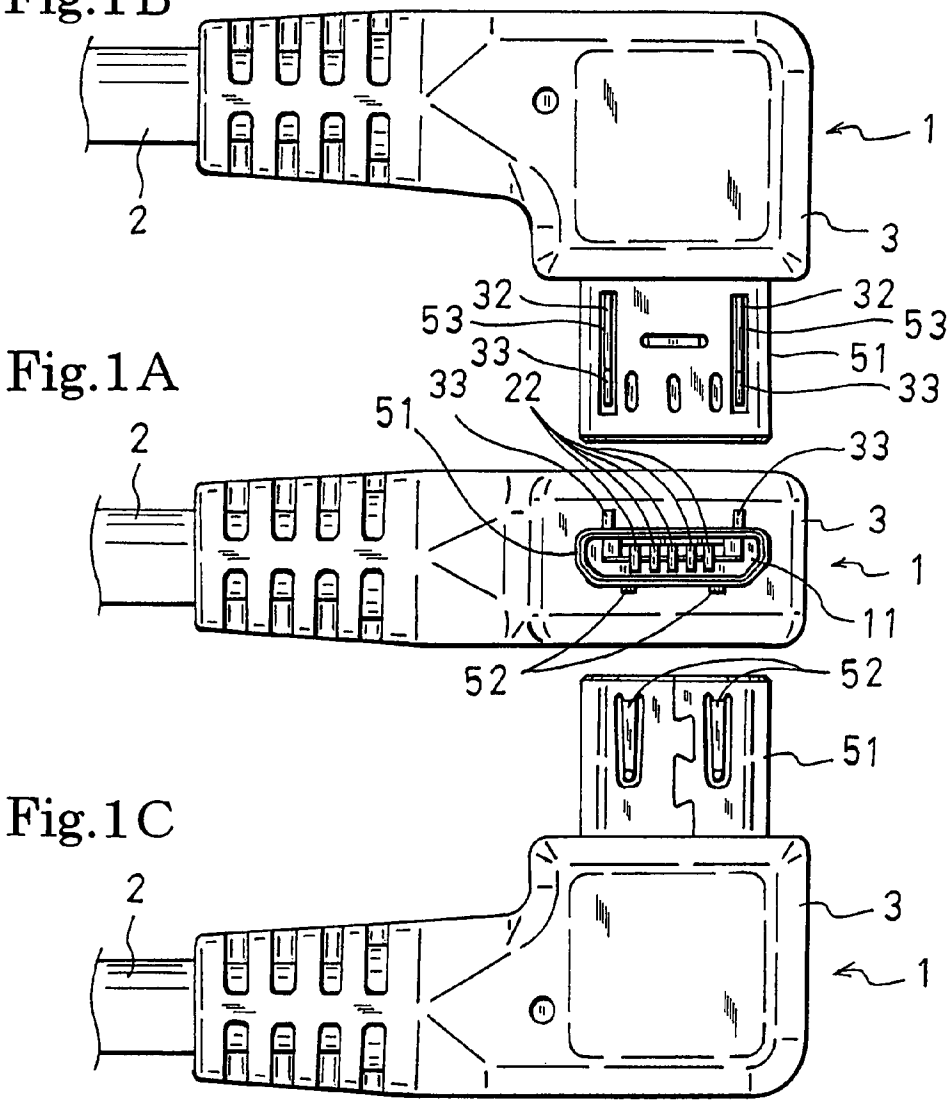
Fig.1B
Fig.1A
Fig.1C

CONNECTOR PLUG

BACKGROUND OF THE INVENTION

1. Field of the Invention

The present invention relates to a connector plug having a slipping-off preventing structure.

2. Description of the Prior Art

Conventionally, known is a connector plug comprising: a synthetic-resin made body having a fitting portion to which a counter connector socket is to be fitted, and which is projected from one end side; contacts which are held by the body; and a metal case (shield) that covers the body, and that has a fixing portion in which a cable configured by binding wires connected to the contacts is placed inside and fixed by performing crimping. When such a connector plug is inserted into or extracted from a receptacle (counter connector socket) disposed in a portable telephone or the like, the contacts disposed in the connector plug are connected to or disconnected from contacts disposed in the receptacle. For example, such a connector plug is used with being inserted into a receptacle of a portable telephone to attain fitting connection in the case where electrical signals are to be transmitted and received between an apparatus on the side of the connector plug and the portable telephone, or an electric power is to be supplied to the portable telephone. In such a connector plug, a slipping-off preventing structure for, even when vibrations or an external force is applied, preventing the connector plug from slipping off from the receptacle of the portable telephone is important. A connector plug comprising, as such a slipping-off preventing structure, a latch which is formed by a metal plate, and which, when a fitting portion of a body is inserted into a receptacle, is engaged with an engaging portion disposed in the receptacle is known. For example, a connector plug having a structure in which a metal case covers a body excluding a fitting portion comprises a latch having a cantilevered structure that extends from the metal case to the fitting portion of the body, and that is integrated with the metal case (see Japanese Patent Application Laying-Open Nos. 2001-291556 and 2002-198125). A connector plug having a structure in which a metal case covers a body including a fitting portion, such as a USB connector standard compliant connector plug comprises a latch having a cantilevered structure that is cut and raised from a tubular portion of the metal case covering the fitting portion of the body, and that is integrated with the metal case (see Japanese Patent Application Laying-Open Nos. 2003-243093 and 2004-87462). The latch disposed in the latter connector plug can be bent only in the thickness direction, and hence it is structurally difficult to obtain a large engaging force (elastic force) (as compared with the latch disposed in the former connector plug). When vibrations or an external force is applied, hence, there is a high possibility that the engagement is lost and the slipping-off prevention of the connector plug is cancelled. By contrast, the latch disposed in the former connector plug can be bent in the width direction, and hence it is structurally easy to obtain a large engaging force (as compared with the latch disposed in the latter connector plug). Even when vibrations or an external force is applied, hence, the possibility that the engagement is lost and the slipping-off prevention of the connector plug is cancelled is low.

SUMMARY OF THE INVENTION

In a portable telephone, as miniaturization and thinning are advanced and the multifunctionality is expanded, the mounting space for a receptacle is reduced. In accordance with the reduction, a connector (a receptacle and a plug) is strongly requested to be miniaturized and thinned. However, a conventional connector plug has a problem in that, when the thickness of a metal case is reduced, also that of a latch which is integrated with the metal case is reduced, and hence a necessary engaging force cannot be obtained.

It is an object of the invention to provide a connector plug in which a necessary and sufficient engaging force of a latch can be ensured irrespective of the thickness of a metal case. It is another object of the invention to provide a connector plug in which the reduction of the engaging force of a latch caused by repeated insertion into and extraction from a counter connector socket can be suppressed and a necessary and sufficient engaging force can be maintained.

In order to attain the objects, the connector plug of the invention is a connector plug comprising: a synthetic-resin made body having a fitting portion to which a counter connector socket is to be fitted, and which is projected from one end side; contacts which are held by the body; and a metal case which covers the body, wherein a latch which, when the fitting portion of the body is inserted into the counter connector socket, causes the fitting portion to be engaged with the counter connector socket, and which is formed by a metal plate is configured separately from the metal case, and the latch is held by the body.

According to the configuration, the latch, which is conventionally integrated with the metal case, is separately configured, and hence a necessary and sufficient engaging force can be ensured irrespective of the thickness of the metal case.

In the connector plug of the invention, preferably, an engaging portion which receives a load applied to the latch is disposed in the metal case.

According to the configuration, a load applied to the latch is received by the metal case, and hence it is possible to suppress a phenomenon that the synthetic-resin made body is shaved by the latch formed by a metal plate by means of repeated insertion into and extraction from the counter connector socket, to reduce the holding force of the latch, and, in accordance with the reduction, the engaging force is reduced. Therefore, a necessary and sufficient engaging force can be maintained. In the case where the holding force of the latch is to be enhanced only by the body, it is necessary to enlarge the range where the latch is held by the body, or to reduce the size of the latch itself. When the range where the latch is held by the body is enlarged, the size of the connector plug is made large, and, when the size of the latch itself is reduced, a necessary engaging force cannot be obtained. It is not required to perform these countermeasures. Therefore, a necessary and sufficient engaging force can be ensured and maintained without causing the size of the connector plug to be enlarged.

In the connector plug of the invention, preferably, it is configured so that the latch is thicker than the metal case.

According to the configuration, the thickness of the latch is larger than that of the metal case, and hence a larger engaging force can be obtained as compared with the conventional case where the latch is integrated with the metal case.

In the connector plug of the invention, preferably, the latch has: a spring portion which is formed by stamping a metal plate into a substantially U-like shape; an arm portion which extends flushly from one end side of the spring portion; an engaging portion which is disposed on a tip end side of the arm portion; a fulcrum portion which extends flushly from another end side of the spring portion; and a projecting portion which is to be engaged with the engaging portion of the metal case.

According to the configuration, the arm portion of the latch is flexed in the width direction, and hence the latch is configured so that it is structurally easy to obtain a large engaging force.

In the connector plug of the invention, preferably, it is configured so that the engaging portion of the metal case is a hole disposed in the metal case, and the projecting portion of the latch is a projecting piece having a section shape corresponding to a hole shape of the engaging portion of the metal case.

According to the configuration, a load applied to the latch can be received more surely by the metal case. Therefore, the reduction of the engaging force can be suppressed more surely, and a necessary and sufficient engaging force can be ensured and maintained more surely. The metal case can receive not only a load due to adequate insertion into or extraction from a counter connector socket, but also an abnormal load which is applied to the latch by inadequate insertion or extraction such as prying. Therefore, the prying resistance can be improved. When the projecting portion of the latch is fitted into the engaging portion of the metal case, the latch can be positioned with respect to the metal case.

In the connector plug of the invention, preferably, the engaging portion of the metal case is disposed in the vicinity of a body-positioning hole or projection which is disposed in the metal case.

According to the configuration, positioning portions of the body and the latch with respect to the metal case are close to each other, and hence the positional relationship between the body and the latch can be accurately determined. Therefore, a load applied to the latch can be adequately received by the metal case while the latch is correctly held by the body.

In the connector plug of the invention, preferably, the metal case has a tubular portion which covers the fitting portion of the body. Preferably, the connector plug is a micro USB connector plug which is compliant with a micro USB connector standard. Even in such a connector plug, the configuration where the latch, which is conventionally integrated with the metal case, is separately configured enables a necessary and sufficient engaging force to be ensured irrespective of the thickness of the metal case. Since the engaging portion which receives a load applied to the latch is disposed in the metal case, a necessary and sufficient engaging force can be maintained.

As described above, according to the connector plug of the invention, the configuration where the latch, which is conventionally integrated with the metal case, is separately configured enables a necessary and sufficient engaging force to be ensured irrespective of the thickness of the metal case. Furthermore, an engaging force which has been ensured can be maintained by disposing the engaging portion which receives a load applied to the latch, in the metal case. Therefore, further miniaturization and thinning of a connector are enabled.

BRIEF DESCRIPTION OF THE DRAWINGS

FIG. 1 is a view showing the appearance of a connector plug of an embodiment of the invention in which (A) is a front view, (B) is a plan view, (C) is a bottom view, and (D) is a side view.

Hereinafter, an embodiment of the invention will be described in detail with reference to the accompanying drawings. In FIG. 1, the reference numeral 1 denotes a B-type L-shaped plug (connector plug) which cooperates with an AB- or B-type receptacle (counter connector socket) that is disposed in a portable telephone or the like, and that is not shown, to constitute a micro USB connector which is compliant with the micro USB connector standard. The connector plug is attached to an end of a cable 2 in which plural wires are bundled. A range from the root of a fitting portion for the receptacle to an extension end portion of the cable 2 is continuously integrally covered by an over-mold resin 3.

As shown in FIGS. 2 to 4, the plug 1 is configured by a body 10, plural (five) contacts 20, plural (two) latches (lock springs) 30, and a metal case 40.

As shown in FIGS. 2 to 4, the body 10 is made of an insulative synthetic resin, and has the fitting portion 11 which is to be fitted into the receptacle from one end side (front end side) that is on the front side when the plug 1 is inserted into the receptacle, and which is projected continuously integrally. A recess 12 in which a sectional shape extending from the tip end of the fitting portion 11 to the vicinity of the root is formed into a recessed shape is formed in one surface of the fitting portion 11. In the recess 12 of the fitting portion 11, plural (five) slit-like contact attachment grooves 13 are formed while being arranged in the lateral direction perpendicular to the direction along which the plug 1 is inserted into the receptacle, and also to the thickness direction of the plug 1. The contact attachment grooves 13 are passed through one end side (rear end side) of the body 10 that is on the rear side when the plug 1 is inserted into the receptacle. One slit-like latch attachment groove 14 is formed parallel to the contact attachment grooves 13 in each of right and left side portions of the fitting portion 11 which are outside with respect to the recess 12. The latch attachment grooves 14 are passed through the rear end side of the body 10, and rear end portions of the latch attachment grooves 14 are opened in the surface of the body 10 which is opposite to the recess 12. In the surface of the body 10 which is opposite to the recess 12, body-positioning projections (or recesses) 15 are integrally disposed in the vicinity of the rear end portions of the latch attachment grooves 14 which are opened in the surface.

As shown in FIG. 2, the contacts 20 are formed by stamping and bending a thin metal plate which is highly electrically conductive, and press-inserted from the rear end side of the body 10 into the contact attachment grooves 13 to be attached and held in parallel by the body 10. In the attached state, the contacts 20 are held by the body 10 while rear half portions (fulcrum portions) of the contacts 20 are fitted into rear half portions of the contact attachment grooves 13. Arm portions 21 which are front half portions of the contacts 20 that integrally extend from the rear half portions of the contacts 20 to the front side are fitted into front half portions of the contact attachment grooves 13 so as to be elastically displaceable in the thickness direction (vertical direction) of the plug 1. Mountain-like contacting portions 22 which are integrally formed on the tip end sides of the arm portions 21 are projected and held in the recess 12 of the fitting portion 11. Rear end portions of the contacts 20 which are projected toward the rear end of the body 10 are bent substantially perpendicularly so as to extend along the rear end face of the body 10, to be formed into soldering portions 23 to which the wires of the cable 2 are soldered.

As shown in FIGS. 1 to 4, the metal case 40 has a two-piece structure, and is configured by: a shell 50 which is formed by stamping and bending a thin metal plate; and a cover 60 which is formed by stamping and bending a thin metal plate that is slightly thicker than the shell 50. In a state where the shell 50 is placed on the surface side of the body 10 which is opposite to the body-positioning projections, and the cover 60 is placed on the surface side of the body 10 on the side of the body-positioning projections 15, the shell 50 and the cover 60 are fitted and integrated with each other while sandwiching the body 10, thereby covering the body 10. The shell 50 integrally has a tubular portion 51 which is bendingly formed on one end portion of the shell, and which covers the fitting portion 11 of the body 10. In the tubular portion 51, cantilevered grounding contact pieces 52 are cut and raised, and placed respectively in right and left side portions of the surface of the fitting portion 11 which is opposite to the recess 12, and elongated latch access ports 53 which are opened correspondingly with the latch attachment grooves 14 disposed in the right and left side portions of the surface of the fitting portion 11 outside with respect to the recess 12 are disposed. On the other hand, body-positioning holes (or projections) 61 into which the body-positioning projections 15 projecting from the surface of the body 10 which is opposite to the recess 12 are to be fitted, and latch-positioning holes 62 which are opened correspondingly with rear end portions of the latch attachment grooves 14 opened in the surface of the body 10 which is opposite to the recess 12 are disposed in the cover 60. Furthermore, the cover 60 integrally has a fixing portion 63 which is projected from the rear end side of the cover in one direction (cable drawing-out direction) that is perpendicular to the fitting portion 11 of the body 10, and in which the cable 2 is placed and then fixed by crimping.

As shown in FIGS. 1 to 4, the latches 30 are formed by stamping and bending a thin metal plate which is slightly thicker than the cover 60 of the metal case 40, and press-inserted from the rear end of the body 10 into the latch attachment grooves 14 to be attached and held by the body 10 in parallel to the contacts 20 in the right and left outer sides of the contacts 20. Each of the latches 30 has a spring portion 31 which is formed by stamping a metal plate into a substantially U-like shape, on the rear end side, and further has: an arm portion 32 which extends flushly from one end side of the spring portion 31 toward the front side; a mountain-like engaging portion 33 which is integrally disposed on the tip end side of the arm portion 32; a fulcrum portion 34 which extends flushly from another end side of the spring portion 31 toward the front side; and a projecting portion 35 which is flushly projected from a root portion of the fulcrum portion 34 (the other end side of the spring portion 31) toward the outer side in a perpendicular direction. The projecting portion 35 is a projecting piece having a sectional shape corresponding to the shape of the latch-positioning holes 62 of the metal case 40. In the attached state, the latch 30 is held by the body 10 while the spring portion 31, root portion of the arm portion 32, and fulcrum portion 34 which are in the rear half portion of the latch 30 are fitted into the rear half portion of the latch attachment groove 14, the arm portion 32 which is in the front half portion of the latch 30 is fitted into the front half portion of the latch attachment groove 14 so as to be elastically displaceable in the thickness direction (vertical direction) of the plug 1, and the engaging portion 33 is projected and held from the front end portion of the latch attachment groove 14 to the outer surface of the tubular portion 51 covering the fitting portion 11, through the latch access port 53. The projecting portion 35 of the latch 30 is fitted into the latch-positioning hole 62 of the metal case 40 from the rear end portion of the latch attachment groove 14. In this way, the latches 30 which are configured separately from the metal case 40 are held by the body 10, and further held (positioned) by the metal case 40, so that a load (turning moment) applied to the latches 30 is received through the projecting portions 35 by engaging portions 64 at the rear ends of the latch-positioning holes 62 of the metal case 40.

Figure 2:
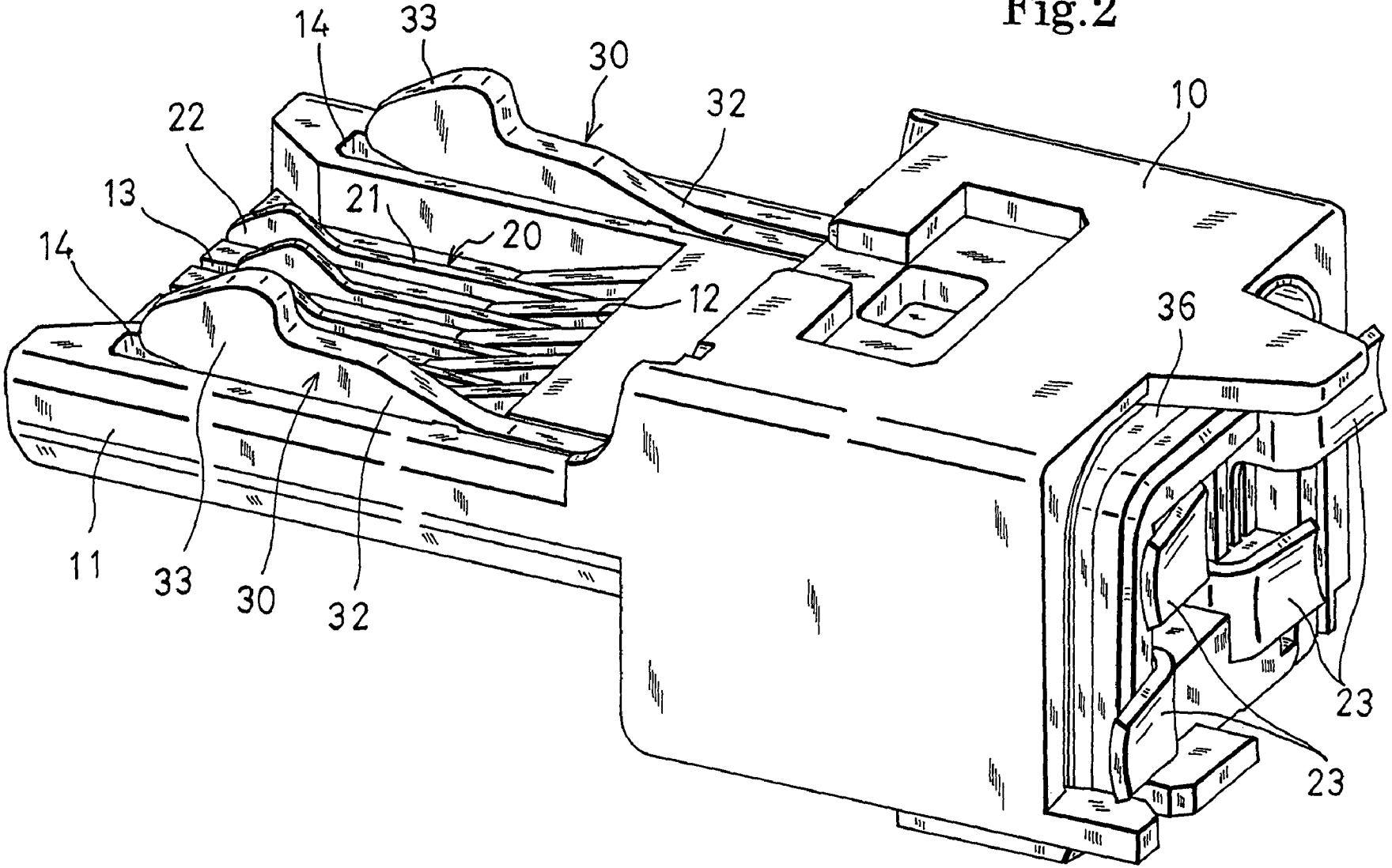
FIG. 2 is a perspective view showing the body structure of the connector plug.
Figure 3:
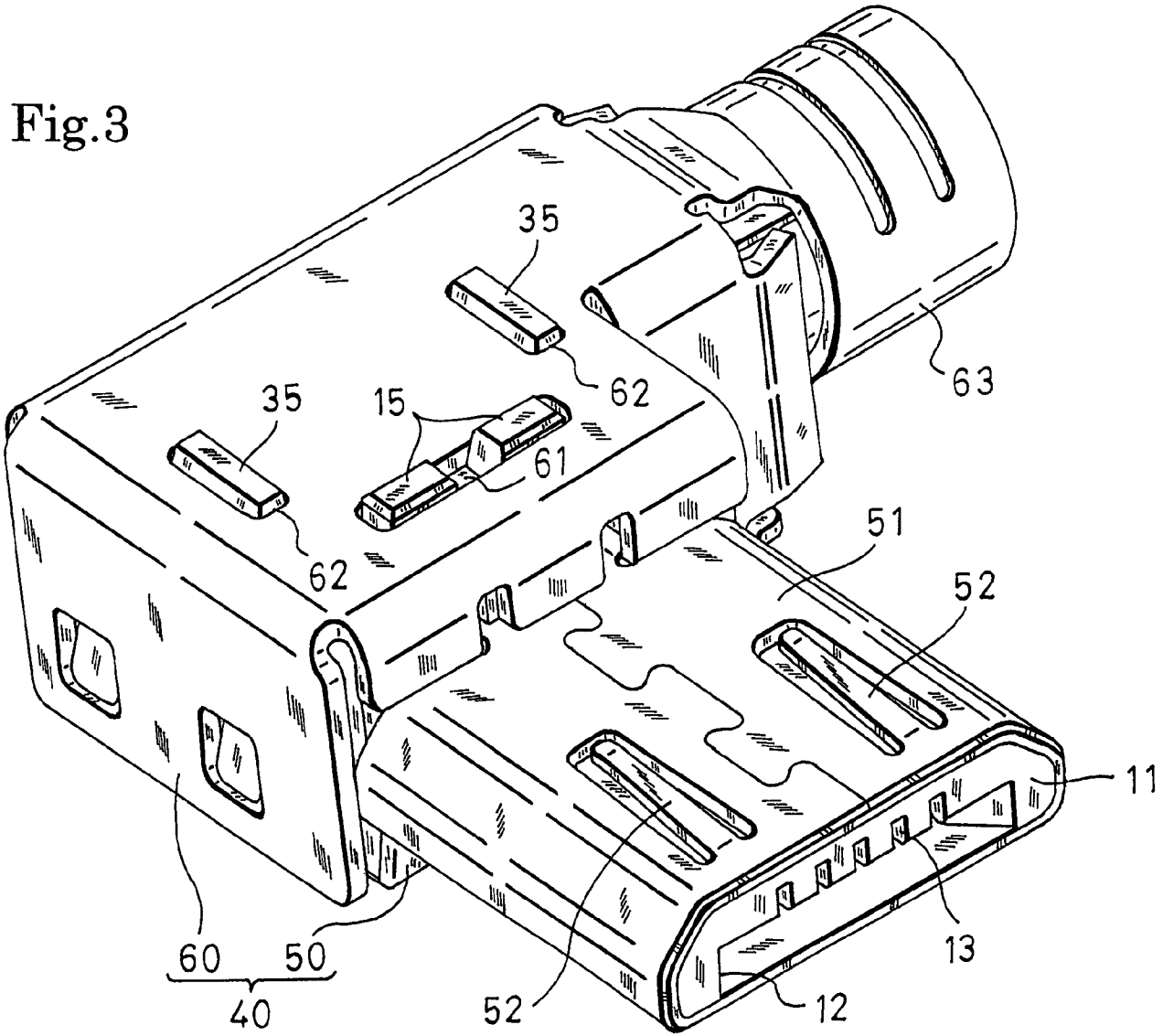
FIG. 3 is a perspective view showing the structure of a metal case of the connector plug.

In the thus configured plug 1, the fitting portion 11 covered by the tubular portion 51 of the metal case 40 is inserted into a receptacle of a portable telephone to attain fitting connection, whereby the contacting portions 22 of the contacts 20 of the plug 1 are contacted with contacts of the receptacle to be electrically connected with each other, so that electrical signals are transmitted and received between an apparatus on the side of the connector plug 1 and the portable telephone, or an electric power is supplied to the portable telephone.

Figure 4:
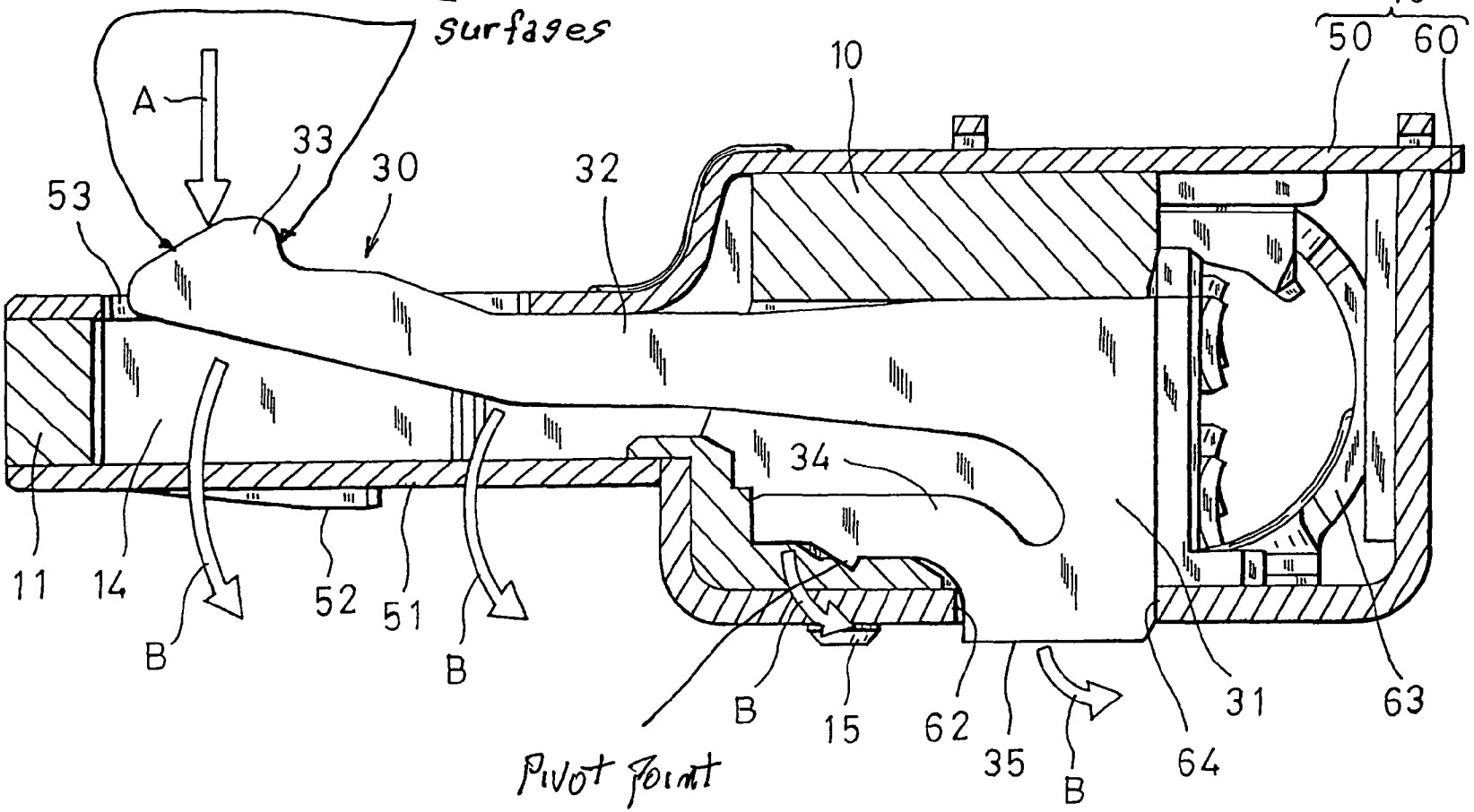
FIG. 4 is a section view showing the structure of a latch of the connector plug.

In each of the latches 30 of the plug 1, when the fitting portion 11 is inserted into the receptacle, the engaging portion 33 is pressed down in the direction of the arrow A of FIG. 4. For this purpose, the engaging portion 33 has slanting surfaces 33*a* and 33*b*. In accordance with this, the arm portion 32 is flexed against the elastic force of the spring portion 31, and the fitting portion 11 is completely inserted into the receptacle, so that engaging portion 33 corresponds to an engaging hole disposed in the receptacle. Therefore, the arm portion 32 is caused by the elastic force of the spring portion 31 to be restored to the original state shown in FIG. 4, and the engaging portion 33 is fitted into the engaging hole to be engaged therewith, whereby slipping-off of the plug 1 from the receptacle is prevented from occurring. In a manner similar to the case of insertion, when fitting portion 11 is to be extracted from the receptacle, the engaging portion 33 is pressed down in the direction of arrow A of FIG. 4, and, in accordance with this, the arm portion 32 is flexed against the elastic force of the spring portion 31, thereby enabling the plug 1 to be extracted from the receptacle. When the plug 1 is extracted from the receptacle, the engaging portion 33 and the arm portion 32 are caused by the elastic force of the spring portion 31 to be restored to the original state shown in FIG. 4.

The latches 30 of the plug 1 are configured separately from the metal case 40, and held by the body 10. Therefore, the thickness of the latches 30 required for ensuring an engaging force which is necessary and sufficient for preventing slipping-off can be ensured irrespective of the thickness of the metal case 40, and an engaging force which is necessary and sufficient for preventing slipping-off of the plug 1 can be ensured irrespective of miniaturization and thinning of the connector (the plug 1 and the receptacle). In other words, miniaturization and thinning of the connector (the plug 1 and the receptacle) is not impeded by an insufficiency of the engaging force for preventing the plug 1 from slipping off.

The body 10 of the plug 1 including the fitting portion 11 for a receptacle is covered by the metal case 40. The configuration where the metal case 40 is separated from the latches 30 enables the latches 30 to have a structure in which the arm portions 32 are flexed in the width direction. Therefore, it is possible to obtain a large engaging force (elastic force) as compared with a latch in which an arm portion is flexed in the thickness direction. Moreover, the latches 30 are thicker than the metal case 40. Therefore, it is possible to obtain a large engaging force as compared with a conventional latch which is integrated with a metal case. As a result, the plug 1 has a high reliability of prevention of slipping off.

When insertion or extraction of the fitting portion 11 into and from the receptacle causes the engaging portions 33 of the latches 30 to be pressed down in the direction of the arrow A of FIG. 4, the whole of the latches 30 tries to swing in the direction of the arrow B of FIG. 4, and the fulcrum portions 34 of the latches 30 try to shave the body 10. In the case where the latches 30 are configured separately from the metal case 40 as described above, the latches are held by the body 10, and moreover the projecting portions 35 of the latches 30 are fitted into the latch-positioning holes 62 disposed in the metal case 40, so that the latches 30 are positioned with respect to the metal case 40 and the latches 30 are held also by the metal case. Therefore, the swing of the latches 30 can be suppressed by the engaging portions 64 of the metal case 40, i.e., a load (turning moment) applied to the latches 30 can be received by the engaging portions 64 of the metal case 40, whereby swing displacement of the latches 30 can be surely suppressed. Consequently, it is possible to suppress a phenomenon that the synthetic-resin made body 10 is shaved by the latches 30 formed by a metal plate by means of repeated insertion and extraction of the plug 1 into and from a receptacle, to reduce the holding force of the latches 30, and, in accordance with the reduction, the engaging force of preventing the plug 1 from slipping off is reduced. As a result, an engaging force which is necessary and sufficient for preventing the plug 1 from slipping off can be maintained.

In the case where the holding force of the latches 30 is to be enhanced only by the body 10, it is necessary to enlarge the range where the latches 30 is held by the body 10, or to reduce the size of the latches 30 themselves. When the range where the latches is held by the body 10 is enlarged, the size of the plug 1 is made large, and, when the size of latches 30 themselves is reduced, an engaging force required for prevention of slipping-off cannot be obtained. However, it is not required to perform these countermeasures. Therefore, an engaging force which is necessary and sufficient for preventing the plug 1 from slipping-off can be ensured and maintained without causing the size of the plug 1 to be enlarged.

Furthermore, the engaging portions 64 of the metal case 40 are the latch-positioning holes 62 disposed in the metal case 40, the projecting portions 35 of the latches 30 are projecting pieces having a sectional shape corresponding to the shape of the engaging portion holes of the metal case 40, and a load applied to the latches 30 can be received more surely by the metal case 40. Therefore, the reduction of the engaging force of preventing the plug 1 from slipping-off can be suppressed more surely, and an engaging force which is necessary and sufficient for preventing the plug 1 from slipping-off can be ensured and maintained more surely. The metal case 40 can receive not only a load due to adequate insertion into or extraction from the receptacle, but also an abnormal load which is applied to the latches 30 by inadequate insertion or extraction such as prying. Therefore, the prying resistance can be improved.

Moreover, the engaging portions 64 of the metal case 40 are disposed in the vicinity of the body-positioning holes which are disposed in the metal case 40, the positioning portions of the body 10 and the latches 30 with respect to the metal case 40 are close to each other, and hence the positional relationships between the body 10 and the latches 30 can be accurately determined. Therefore, a load applied to the latches 30 can be adequately received by the metal case 40 while the latches 30 are correctly held by the body 10.

Although the preferred embodiment of the connector plug of the invention has been described with the plug 1 of a micro USB connector, the invention is not restricted to this, and various modifications may be made without departing from the spirit of the invention. For example, the above-described embodiment has the structure in which the rear end sides of the right and left latches 30 are integrated with each other through a joining portion 36. Alternatively, a structure in which the latches are completely independent and separate from each other may be employed.

INDUSTRIAL APPLICABILITY

The invention may be preferably used also in a structure of preventing slipping off of a connector plug in which a latch for preventing the connector plug from slipping off from a counter connector socket is disposed on the side of the counter connector socket.

What is claimed is:

1. A connector plug, comprising:

a synthetic-resin made body having a fitting portion to which a counter connector socket is to be fitted, and which projects from one end side;

contacts which are held by said body;

a metal case which covers said body, said metal case having an engaging portion; and a latch which, when said fitting portion of said body is inserted into the counter connector socket, causes said fitting portion to be engaged with the counter connector socket, and which is formed by a metal plate configured separately from said metal case, said latch being held by said body, wherein:

said latch has: a spring portion which is formed by stamping a metal plate into substantially U-like shape; an arm portion which extends flushly from one end side of said spring portion; an engaging portion which is disposed on a tip end side of said arm portion, and which receives a load applied to said latch; a fulcrum portion which extends flushly from another end side of said spring portion; and a projecting portion which extends from another end side of said spring portion is to be engaged with said engaging portion disposed within said metal case.

2. The connector plug according to claim 1, wherein: said latch is thicker than said metal case.

3. The connector plug according to claim 1, wherein: said metal case has a tubular portion which covers said fitting portion of said body.

4. The connector plug according to claim 1, wherein: said connector plug is a micro USB connector plug which is compliant with a micro USB connector standard.

5. A connector plug, comprising:

a synthetic-resin made body having a fitting portion to which a counter connector socket is to be fitted, and which projects from one end side;

contacts which are held by said body;

a metal case which covers said body, said metal case having an engaging portion; and a latch which, when said fitting portion of said body is inserted into the counter connector socket, causes said fitting portion to be engaged with the counter connector socket, and which is formed by a metal plate configured separately from said metal case, said latch being held by said body, wherein:

said latch has: a spring portion which is formed by stamping a metal plate into substantially U-like shape; an arm portion which extends flushly from one end side of said spring portion; an engaging portion which is disposed on a tip end side of said arm portion, and which receives a load applied to said latch; a fulcrum portion which extends flushly from another end side of said spring portion; and a projecting portion which extends from another end side of said spring portion is to be engaged with said engaging portion of said metal case, said engaging portion of said metal case is a hole disposed in said metal case, and said projecting portion of said latch is a projecting piece having a section shape corresponding to a hole shape in said engaging portion of said metal case.

6. The connector plug according to claim 5, wherein: said latch is thicker than said metal case.

7. The connector plug according to claim 5, wherein: said metal case has a tubular portion which covers said fitting portion of said body.

8. The connector plug according to claim 5, wherein: said connector plug is a micro USB connector plug which is compliant with a micro USC connector standard.

9. A connector plug, comprising:

a synthetic-resin made body having a fitting portion to which a counter connector socket is to be fitted, and which projects from one end side;

contacts which are held by said body;

a metal case which covers said body, said metal case having an engaging portion; and a latch which, when said fitting portion of said body is inserted into the counter connector socket, causes said fitting portion to be engaged with the counter connector socket, and which is formed by a metal plate configured separately from said metal case, said latch being held by said body, wherein:

said latch has: a spring portion which is formed by stamping a metal plate into substantially U-like shape; an arm portion which extends flushly from one end side of said spring portion; an engaging portion which is disposed on a tip end side of said arm portion, and which receives a load applied to said latch; a fulcrum portion which extends flushly from another end side of said spring portion; and a projecting portion which extends from another end side of said spring portion is to be engaged with said engaging portion of said metal case, said engaging portion of said metal case is a hole disposed in the vicinity of a body-positioning hole or projection which is disposed in said metal case, and said projecting portion of said latch is a projecting piece having a section shape corresponding to a hole shape in said engaging portion of said metal case.

10. The connector plug according to claim 9, wherein: said latch is thicker than said metal case.

11. The connector plug according to claim 9, wherein: said metal case has a tubular portion which covers said fitting portion of said body.

12. The connector plug according to claim 9, wherein: said connector plug is a micro USB connector plug which is compliant with a micro USC connector standard.

13. A connector plug, comprising:

a synthetic-resin made body having a fitting portion to which a counter connector socket is to be fitted, and which projects from one end side;

contacts which are held by said body;

a metal case which covers said body, said metal case having an engaging portion; and a latch which, when said fitting portion of said body is inserted into the counter connector socket, causes said fitting portion to be engaged with the counter connector socket, and which is formed by a metal plate configured separately from said metal case, said latch being held by said body, wherein:

said latch has: a spring portion which is formed by stamping a metal plate into substantially U-like shape; an arm portion which extends flushly from one end side of said spring portion; an engaging portion which is disposed on a tip end side of said arm portion; said engaging portion of said latch having slanting surfaces which receive a load applied to said latch; a fulcrum portion which extends flushly from another end side of said spring portion; and a projecting portion which extends from another end side of said spring portion is to be engaged with said engaging portion disposed within said metal case.

14. The connector plug according to claim 13, wherein: said latch is thicker than said metal case.

15. The connector plug according to claim 13, wherein: said metal case has a tubular portion which covers said fitting portion of said body.

16. The connector plug according to claim 13, wherein: said connector plug is a micro USB connector plug which is compliant with a micro USC connector standard.

17. A connector plug, comprising:

a synthetic-resin made body having a fitting portion to which a counter connector socket is to be fitted, and which projects from one end side;

contacts which are held by said body;

a metal case which covers said body, said metal case having an engaging portion; and a latch which, when said fitting portion of said body is inserted into the counter connector socket, causes said fitting portion to be engaged with the counter connector socket, and which is formed by a metal plate configured separately from said metal case, said latch being held by said body, wherein:

said latch has: a spring portion which is formed by stamping a metal plate into substantially U-like shape; an arm portion which extends flushly from one end side of said spring portion; and an engaging portion which is disposed on a tip end side of said arm portion; a fulcrum portion which extends flushly from another end side of said spring portion, said fulcrum portion having a pivot point about which said latch pivots; and a projecting portion which extends from another end side of said spring portion is to be engaged with said engaging portion disposed within said metal case.

18. The connector plug according to claim 17, wherein: said latch is thicker than said metal case.

19. The connector plug according to claim 17, wherein: said metal case has a tubular portion which covers said fitting portion of said body.

20. The connector plug according to claim 17, wherein: said connector plug is a micro USB connector plug which is compliant with a micro USC connector standard.

* * * * *